US006851354B2

(12) United States Patent
Morisse

(10) Patent No.: US 6,851,354 B2
(45) Date of Patent: Feb. 8, 2005

(54) DEVICE FOR COMPACTING MATTER SUCH AS PACKAGING WASTE

(75) Inventor: Eric Morisse, Toussiant (FR)

(73) Assignee: Techval, Toussaint (FR)

( * ) Notice: Subject to any disclaimer, the term of this patent is extended or adjusted under 35 U.S.C. 154(b) by 0 days.

(21) Appl. No.: 10/668,598

(22) Filed: Sep. 24, 2003

(65) Prior Publication Data

US 2004/0112230 A1 Jun. 17, 2004

(30) Foreign Application Priority Data

Sep. 24, 2002 (FR) ..... 02 11785

(51) Int. Cl.[7] ..... B30B 3/00; B65B 13/02; B02C 1/08

(52) U.S. Cl. ..... 100/25; 100/49; 100/98 R; 100/210; 100/215; 100/218; 100/229 A; 241/101.2

(58) Field of Search ..... 100/3, 8, 25, 39, 100/48, 52, 67, 68, 94, 96, 97, 98 R, 210, 215, 218, 226, 238, 229 A, 295, 49, 95; 241/101.2, 101.72

(56) References Cited

U.S. PATENT DOCUMENTS 3,660,014 A * 5/1972 Ohya ..... 100/238
3,851,577 A * 12/1974 Newcom et al. ..... 100/218
4,426,925 A * 1/1984 Bergmann ..... 100/65
6,520,072 B2 * 2/2003 Chedru et al. ..... 100/35

* cited by examiner

*Primary Examiner*—Allen Ostrager
*Assistant Examiner*—J Nguyen
(74) *Attorney, Agent, or Firm*—Millen, White, Zelano & Branigan, P.C.

(57) ABSTRACT

A compactor according to the invention comprises a bowl (2) for receiving the matter that is to be compacted, a crushing head (1) comprising at least one shredding roll (11) that is mounted to rotate on itself and to move upon the surface of the matter when the compacting head is in an active position inside the bowl, and a pressing device comprising a pressure plate (3) for pressing the matter onto a bottom of said bowl when it is in an active position inside the bowl. Configuration means are further provided to move said crushing head and said pressing device, each in turn, into its active position inside the bowl while the other is in an inactive position outside the bowl.

14 Claims, 6 Drawing Sheets

DEVICE FOR COMPACTING MATTER SUCH AS PACKAGING WASTE

FIELD OF THE INVENTION

The present invention relates to machines for compacting matter, such as those used for compacting waste for destruction or recycling. It applies more specifically to the treatment of packaging waste that are usually made mainly of cardboard.

The storage and recycling of matter made up of disposable cardboard packaging products, based on cardboard and paper and possibly containing further materials such as polymers of organic resins for example (plastics in general) have caused Industry a great deal of problems. The present invention is aimed at solving these problems better than is done by the equipment known to date. Featuring in particular amongst these problems is the problem posed by the space occupied by the matter in a workshop or the need to convey this matter to the site where it is recycled.

DESCRIPTION OF PRIOR ART

In a known way, the compacting of cardboard waste is performed using roll-type compactors which comprise a bowl for receiving the matter that is to be compacted, of circular or rectangular cross section, and a compacting or crushing head. Such a crushing head comprises at least one shredding roll for shredding the matter that is move upon the surface of the waste contained in the bowl. The roll or rolls are generally equipped on their surface with projecting roughnesses in order better to shred the matter, while they are driven in a rotational movement on themselves. The waste matter is introduced progressively, optionally in a continuous manner, by an open upper face of the bowl. In most current roll-type compactors, the head rests under its own weight on the matter, but it is also possible to provide for applying pressure to the matter using other means.

Most roll-type compactors have a bowl of circular cross section, because the crushing head operating therein is made to gyrate about the axis of the bowl, so that the roll is moved upon the surface of the matter therein all over its surface. Such compactors, called as rotary head compactors, are, for example, described in U.S. Pat. No. 6,520,072. However, compactors with bowls of rectangular cross section are also known, in which the compacting or-crushing head is given a pendular movement in the bowl, also in order to act on a maximum area of matter. Such compactors are described, for example, in European patent application EP 0 042 580.

It must be noted that rotary head compactors with a circular bowl are more widespread in the trade than compactors with a rectangular bowl because they are simpler to produce. This is because the crushing head of compactors with rectangular bowls has to have a telescopic arm in order to allow the shredding roll to move back and forth in the bowl over the latter, thus complicating the production of the compactor by comparison with compactors that have a cylindrical bowl.

Having been shredded and compressed, the matter is generally collected in a removable and interchangeable receptacle of the machine, such as a transport bag. It is conventional in this way to form "bales" of compacted matter, which are deposited directly on pallets used for loading them onto trucks for transportation, for example in the case of bales of cardboard, to a paper mill where the matter is recycled.

OBJECT OF THE INVENTION

The principle underlying the invention consists in using, in alternation, in a bowl for receiving-matter that is to be compacted, a crushing head of the rotary roll type and a pressing device of the pressure plate type. In other words, the compactor according to the invention comprises a bowl for receiving the matter that is to be compacted, generally open at the top for continuous filling, and two compacting devices, one involving a shredding roll for crushing the waste matter, the other involving a pressure plate to compress the crushed matter, which are associated with configuration means for bringing them, each in turn, to operate in the bowl while the other is in an inactive position outside the bowl.

According to the invention, the roll of the compacting head is mounted to move in rotation on itself. When the crushing head is in an active position in the bowl, it is mounted to move to make the roll travel over the surface of the matter. The other compacting device comprises a pressure plate applying pressure to the matter, which is preferably sized and arranged in such a way that it extends over the entire area of the waste when in an active position inside the bowl. The pressure plate is mounted so that it can move in translation in the bowl to press the latter against the bottom of the bowl when the plate-type pressing device is in its active position. The roll-type crushing head is preferably a rotative one, which means that in operation it is rotated around a vertical axis of the bowl. According to the invention the bowl can show nevertheless a not circular cross-section, which permits to lead to cubic compacted bales that can be obtained direct in the bowl.

According to other features of the invention the configuration means comprise first configuring means to cause the crushing head with rotary roll to move from an inactive position outside the bowl to its active position inside the bowl when the pressure plate pressing device is set into an inactive position outside the bowl, and vice versa to return it to its active position, and second configuring means for causing the pressure plate pressing device to move from its inactive position in which it is inoperative outside the bowl into its active position inside the bowl when the crushing head is in its inactive position outside the bowl, and vice versa, to return it from its active position to its inactive position.

The compactor according to the invention allows a highly effective compacting of a bale of compacted matter by virtue of the combination of the actions of the roll-type crushing head and of the pressure plate. What actually happens in conventional rotary head compactors as defined above is that the density with which the matter in the bowl is compacted decreases as the level of matter in the bowl rises. This can be explained by the fact that the matter in the bottom of the bowl experiences not only the weight of the roll, but also the weight of the matter heaped up on top of it. By virtue of the pressing device in the compactor according to the invention, the matter is compressed against the bottom of the bowl by the pressure plate, which is advantageously applied under high pressure to it. The plate thus evens out the surface of the matter in the bowl far better than does the weight of the roll and of the upper layers and homogenizes the compacting density in the bale as it sinks down in the bowl. In this way, the compactor according to the invention produces bales the mass of which is uniformly distributed through the volume. All this can be obtained in conjunction with a shredding of the matter by the roll or rolls that known plate-type presses are unable to achieve.

Preferably, and according to the invention, the first configuring means essentially consist of means allowing the crushing head to be driven in vertical translation up to an inactive position above the bowl, while the plate-type pressing device is mounted on the upper end of a lateral wall of the bowl in such a way that it can be pivoted about a horizontal axis to move from its active position wherein the pressure plate is placed horizontal inside the bowl and its inactive position wherein it is placed aside the bowl.

According to a preferred embodiment of the invention, the first configuring means performing the placement of the rotary roll crushing head advantageously consist of means for driving the crushing head in vertical translation. In the preferred embodiments, the roll-type crushing head comprises means of driving the roll in rotation on itself and means for driving it in gyration about the main axis of the bowl, advantageously vertical. Naturally, the same arrangements apply when the crushing head comprises several rotary rolls rather than just one, the assembly of the head bearing the rolls then being driven such that it travels over the surface of the waste during compacting.

The means for the vertical translation of the crushing head consist in particular of the telescopic mounting of one of the ends of an arm in a frame external to the bowl, the other end of this arm bearing the crushing head. The raising or lowering of one of the ends of the arm in the frame may, in particular, be brought about by hydraulic circuits.

The first configuring means also have the role of causing the crushing head to move from an active position inside the bowl to an inactive position out of the bowl. They in particular comprise the aforementioned means of vertical translation (comprising the arm mounted telescopically in a frame external to the bowl, associated with hydraulic circuits) which also allow the crushing head to move from the inactive position to the active position.

To trigger the bringing of the crushing head into the inactive position, or its movement from an active position to an inactive position, the compactor according to the invention preferably comprises means for detecting the level of the crushing head in the bowl. According to a preferred embodiment of the invention which will be detailed hereinafter, the means for detecting the level of the crushing head in the bowl will in particular comprise electric sensors arranged in the bowl.

When the crushing head reaches the level at which the electric level sensors are located, a signal triggering the bringing of the crushing head into the inactive position is transmitted to control means. The control means then trigger the means for placing the crushing head in the inactive position.

According to an advantageous embodiment of the invention, the means for causing the crushing head to move from its active position to its inactive position also comprise sensors sensing the position of the axis of the roll in the bowl. These position sensors are arranged in the bowl. That allows the crushing head to be halted in its gyratory movement at a given radius and also allows the compacting roll to be halted in its movement of rotation on itself, before the crushing head is raised up out of the bowl. In this way, the compacting and shredding roll is stopped in a given position, and this may in particular make it possible to reduce the space occupied by the machine.

Advantageously, the second configuring means, involved in the bringing into position of the pressure plate pressing device, in particular comprise a device for pivoting the pressure plate from a position in which it is laid down flat on the matter in the bowl into a position in which it is raised up clear outside the bowl. In a preferred embodiment of the invention, these means comprise a winch around which there is wound and unwound a cable the end of which is connected to the pressure plate. The second configuring means for bringing the plate device into position also comprise a system of parts projecting from the pressure plate and mounted to be able to move in rails formed in the compactor.

According to a preferred embodiment of the invention, to trigger the bringing of the pressure plate pressing device into the inactive position, the compactor also comprises means of detecting the level of the plate in the bowl. The means of detecting the level of the plate in the bowl advantageously comprise electric plate-level sensors which are arranged in the bowl.

In this way, when the plate is at the level at which it can be detected by the sensors, the latter transmit a signal to control means which trigger the means for causing the pressure plate pressing device to move from its active position to its inactive position.

The same second configuring means are used to cause the compression plate pressing device to move from an inactive position, in which it is retracted outside the bowl, into an active position inside the bowl, through commands the reverse of those used to cause it to move from an active position in the bowl to an inactive position. In both instances, they therefore advantageously involve the winch around which is wound and unwound the cable the end of which is connected to the pressure plate, and the system of parts projecting from the pressure plate which are mounted so that they can move in rails formed in the compactor.

Thus, according to a preferred embodiment of the invention which will be detailed later on, the second configuring means comprise mechanical means for placing the pressing device inside the bowl.

Advantageously, for the translational drive of the pressure plate in the bowl in a direction which is normally vertical over the waste that is to be compacted, the compactor according to the invention comprises at least one gripper which clips onto the plate of the pressing device and is connected to a hydraulic press ram. According to one particular embodiment, the compactor comprises two grippers each of which is associated with one hydraulic ram. The two grippers are advantageously arranged one each side of the bowl, so as to hold the pressure plate via two opposite sides and thus facilitate the translational movement of the plate in the bowl in a balanced manner.

The compactor according to the invention in particular allows a bale of matter to be formed directly in the bowl without having to use a bag. What actually happens is that the compacting of the matter in the bowl is such that the matter sticks together, creating an agglomeration of matter that takes on the interior shape of the bowl as it is compressed by the plate against the internal walls of the bowl. In this way, the user can choose the shape and size of the bales he wishes to produce by specifying the shape of the compactor bowl accordingly, and he no longer has to concern himself with packaging which is now needless.

In its preferred embodiments, the compactor according to the invention also comprises means for binding the bale of matter compressed by the plate so as to maintain the cohesion of all the compacted matter. In this way, the dimensions of the bale and the degree of compacting of the bale which are obtained under the pressure of the plate can be maintained.

For performing this binding, the compactor according to the invention advantageously comprises housings for accommodating reels of tape, guiding means for guiding the tapes to pass around a bale of compacted matter that is still in the compactor bowl, and means for joining the two ends of such a tape together.

According to an advantageous embodiment of the invention, the compactor is constructed so that it is able to dispense with the use of pallets for transporting the bales, for example from the workshop to the truck. For that purpose, the compactor according to the invention advantageously comprises means for shaping the bale, such as a shaping bottom of the bowl. Thus, a bale of compacted matter produced in the compactor can be transported by a fork-lift truck without the need of an intermediate supporting pallet. According to a preferred embodiment of the invention, the inner face of the bottom of the compactor comprises for that purpose projections in the form of strips or bands that are disposed to create in the bowl two grooves for the passage of the two forks of a fork-lift truck. The invention further provides for retracting said projections or similar ones in the same plane as the other parts of a bottom of the bowl from which they are cut off, so that the bale can be ceased directly out of the bowl. Furthermore, such features are useful for liberating the bale from the bowl.

According to another feature of the invention, the compactor preferably comprises means for opening the bowl laterally to remove the bale therefrom. The compactor can here preferably comprise a two-leaf door. Each one of the leaves is articulated about a hinge-forming axis which is horizontal. The opening of the two leaves is preferably semi-automatic. The horizontal mounting of the leaves of the door allows a saving of space in the workshop. This is because the lateral spaces of the compactor have no useful purpose other than to allow the leaves of the door of the compactor to be opened when these leaves are mounted articulated about a vertical axis. By mounting the leaves of the door so that they are articulated about a horizontal axis, no space is wasted on the sides of the compactor when the bowl is open. In addition, as the lower leaf is folded back until its end touches the floor, it constitutes a ramp between the floor and the bottom of the bowl, assisting with the unloading of the bale.

As a preference, the compactor according to the invention comprises means for the semi-automatic ejection of the bale from the bowl. Advantageously, these ejection means are arranged opposite the means for opening the bowl, therefore in particular the doors of the bowl, so as to push the bale toward the doors. According to a preferred embodiment of the invention, the bale-ejecting means are arranged on the opposite lateral side to the one comprising the doors for opening the bowl. As a preference, the bale-ejection means are mounted retractable into one of the walls of the bowl.

Through its various characteristics as have been hereinabove or will be later on defined, described and illustrated, and as may advantageously be applied to industrial practice, the invention in particular allows compacting better suited to the nature of the matter that is to be compacted, particularly by virtue of the possibility offered by the machine of employing sometimes the rotary roll crushing head and sometimes the pressure plate pressing device, or both in repetitive alternation.

BRIEF DESCRIPTION OF THE DRAWINGS

The invention will now be explained more fully in its characteristics and their advantages, considering a preferred embodiment of the compactor according to the invention with reference to FIGS. 1 to 6. In these drawings.

DETAILED DESCRIPTION OF PREFERRED EMBODIMENT

The compactor according to the invention as described here is intended more particularly to process cardboard packaging, which means that matter to be compacted is not necessarily out of cardboard only. Indeed, it can as well include all sorts of cardboard and/or paper laminates, foam parts, polymer or metal films, and generally speaking the compactor can be used to compact any material usually found along with cardboard in waste packaging products.

Figure 1:
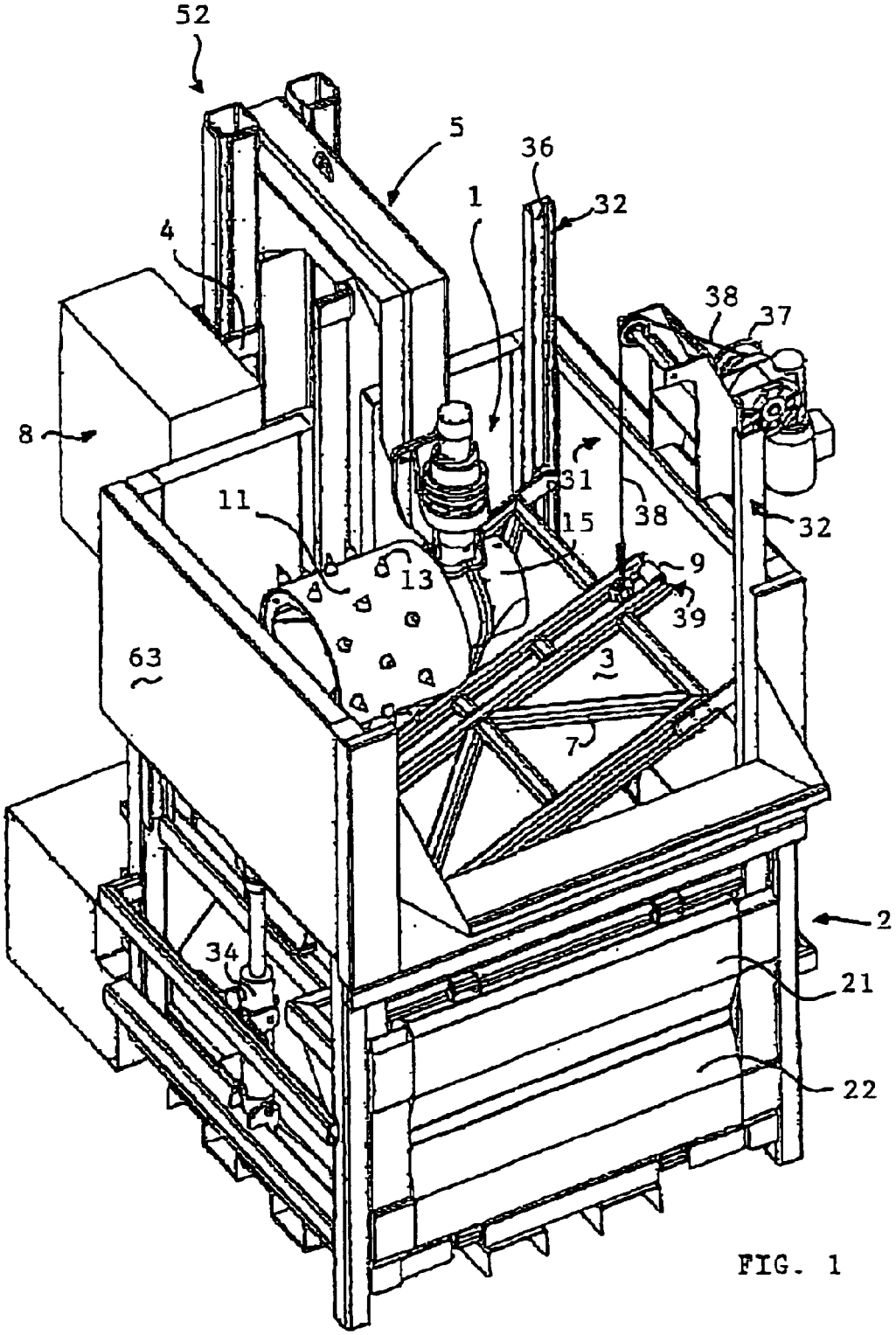
FIG. 1 depicts a preferred embodiment of the compactor according to the invention, viewed in perspective, with the crushing head of which is in an inactive position and the pressing device of which is in place in the bowl.

As illustrated in FIG. 1, the compactor comprises a bowl 2 for receiving the matter that is to be compacted, resting vertically on its bottom and open at the top. When in operation, the matter is introduced from above it. Two compacting devices are made to operate one after the other in the bowl. The one that is operated first is a rotary-roll crushing head 1 mounted at the end of an arm 5, advantageously of cranked shape, which is connected to the end of a frame 4 external to the bowl 2. The other compacting device is a pressing device comprising a pressure plate 3 able to move vertically in the bowl 2. In operation it is moved down to compress the matter previously crushed by the crushing head onto the bottom of the bowl. The crushing head and the pressing device are made to operate in alternation in the bowl 2. In case each is used more than once, it is always the pressing device that operates last.

The crushing head 1 comprises a roll 11 operating essentially by shredding the waste, which is associated with means of rotational drive on itself about its own axis. This roll 11, of which there is just one in the case described, is of cylindrical shape and advantageously has teeth 13 distributed over its surface. According to this preferred embodiment, it is simply under its own weight that the crushing head 1 presses down on the matter in the bowl 2 when it is in its active position. Furthermore, when the crushing head 1 is in the active position inside the bowl 2, the roll 11 is driven in rotation on itself at the same time as the crushing head 1 is driven in gyration about the axis of the bowl 2, this being advantageously done by the same drive means. In other cases, just one of the two movements is imparted by a motor, the other ensuing by reaction.

Figure 3:
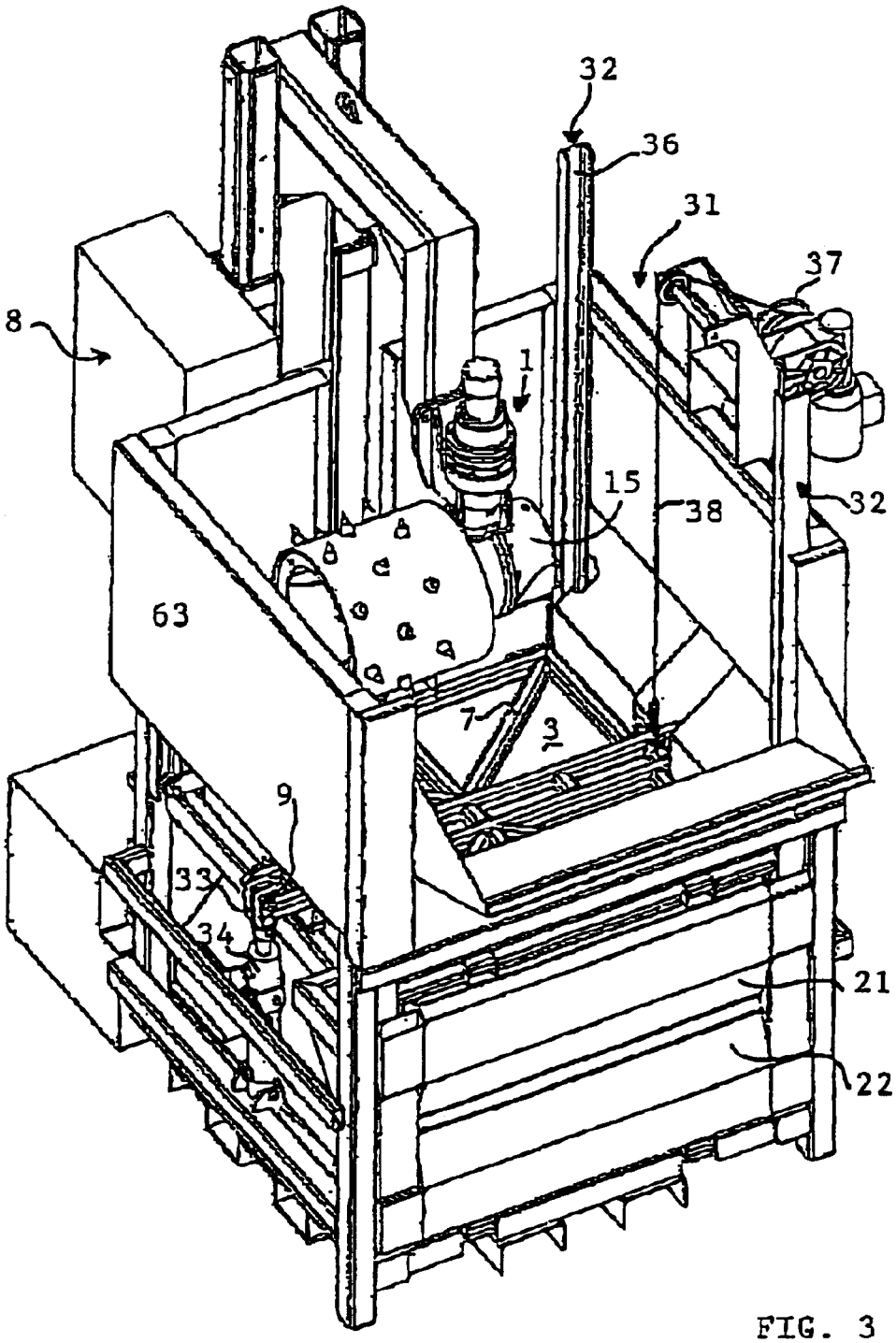
FIG. 3 shows the compactor of FIGS. 1 and 2 when viewed in perspective, the crushing head being in the inactive position and the pressing device in the active position inside the bowl.
Figure 4:
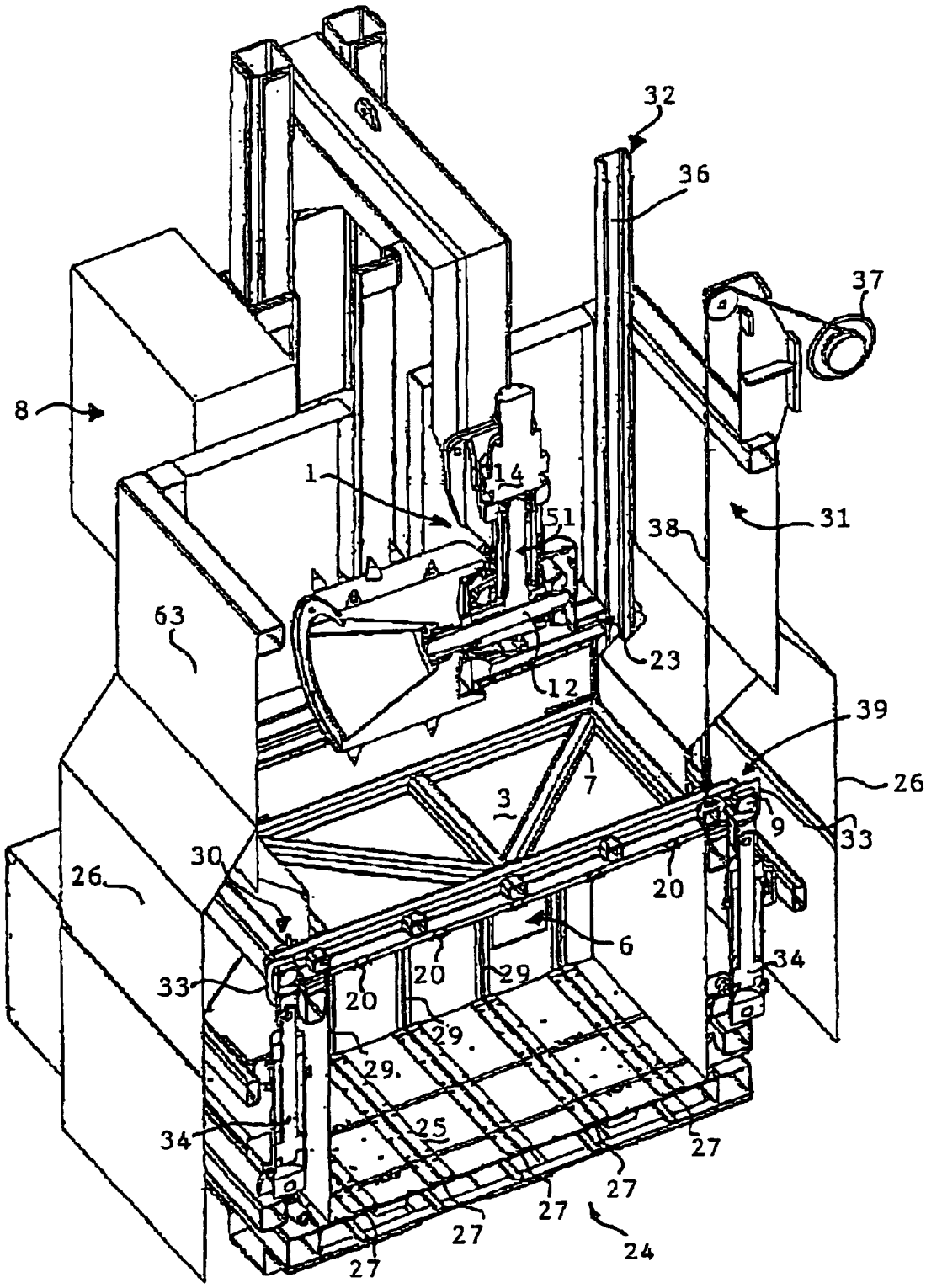
FIG. 4 shows the device of FIG. 3, as equipped with a protective lateral skirt, in a view in longitudinal section.

As is shown in particular schematically in FIG. 4, the means for the rotational drive of the roll 11 on itself and for the gyrational drive of the crushing head 1 in its entirety about the axis of the bowl 2 thus comprise a motor 14, situated at the upper end of the crushing head 1, which drives a vertical shaft 51 mounted along the axis of the bowl, the movement of which is transmitted to an arm 12 for the rotational drive of the roller 11 on itself via an angular transmission mechanism. The members for the rotational drive of the roll 11 on itself and for the gyrational drive of the crushing head 1 about the axis of the bowl are enclosed in a protective casing 16 (FIGS. 1 and 3) which protects them in particular from the attack of the matter that is to be compacted in the bowl.

This advantageous combination of the rotational drive of the roll 11 about its axis and of the gyrational drive about the axis of the bowl of the crushing head assembly 1, makes it possible on the one hand to shred the matter in the bowl and, on the other hand, to exert on the shredded matter a pressure so as to compact them down as the roll 11 gradually passes over them, this pressure advantageously corresponding simply to the weight of the crushing head 1.

The arm 5 of the support frame of the rotary roll crushing head is mounted so that it can move in terms of translation along the frame 4. As is clearly apparent from FIG. 1, the end 52 of the arm 5 which is the opposite end to the end at which the crushing head 1 is mounted, is mounted telescopically in the frame 4. Advantageously, the rising up of the arm 5 in the frame 4 is done under the control of a hydraulic pressure system.

In this way, the crushing head 1 is mounted so that it is able to move in vertical translation along the axis of the bowl 2 and can thus rise up in the bowl 2 as the level of compacted matter in the bowl 2 rises. That also allows the crushing head 1 to be removed from the bowl 2 until it reaches its inactive position where it is high enough up to allow the pressure plate pressing device to pass from its inactive position to its active position.

The compactor according to the invention, as described here, also comprises means for detecting the level of the crushing head 1 in the bowl 2, which means provide control means 8 with a signal to bring the crushing head 1 into the inactive position when this level reaches a predetermined upper threshold. As shown in FIGS. 1 and 4, the control means 8 are advantageously positioned at the outer frame 4 so as to be readily accessible in the event of breakdown.

According to one particularly advantageous embodiment of the compactor according to the invention, the means for detecting the level of the crushing head 1 in the bowl 2 comprise electric proximity detection sensors which are arranged in the tank at several predetermined levels. Some are able for example to determine a reversal of direction of gyration of the rotary roll crushing head and others are able to detect the rising of this head back up above the bowl 2 to a predetermined level at which it is kept in its inactive position. The bringing of the crushing head 1 into its inactive position may also be instigated by the operator, by pressing a button connected to the control means 8, in the event of detection means deficiency. That makes it possible either, when producing a compacted bale, to call upon the intervention of the pressure plate device, or to remove the bale when the bale is finished.

The compactor according to the invention is produced in such a way that it can implement unclogging operations according to the method described in U.S. Pat. No. 6,520,072. For that purpose, it comprises means for detecting the force exerted by the shaft 51, means for commanding the stopping of the shaft 51, or for forcing it to run in a direction of rotation, or to run in the other direction of rotation. According to this preferred embodiment of the compactor according to the invention, the force detection means act automatically on the control means 8 and on the means for raising the crushing head.

More specifically, when a blockage in the bowl 2 occurs, in other words when the crushing head 1 is prevented from effecting its gyrational movement about the axis of the bowl because a group of matter has massed together into a clump that is difficult to shred, the gyrational movement of the crushing head 1 about the axis of the bowl is stopped, the head is raised, and it moves to the other side of the clump of matter. It is then lowered back down onto the clump of matter, driven in the opposite direction to the direction of the gyratory movement performed by the crushing head 1 before it was raised.

As explained previously, the compactor according to the invention comprises, in addition to the rotary roll head which works mainly by shredding matter present in the bowl, a platen or pressure plate pressing device 3. The action of this pressure plate pressing device supplements that of the crushing head 1 on the matter. The pressure plate 3 in particular allows the compacting density of the matter in the bowl to be homogenized. It also allows the matter to be pressed toward the bottom of the bowl 2 and against the internal side walls of the bowl more intensely than the crushing head 1, and makes it possible in this way to obtain a bale of matter having the same shape as the internal shape of the bowl.

The pressure plate 3 therefore allows the user to obtain, in particular, bales having a level of compacting that the user will have chosen beforehand or a height that he will have chosen beforehand.

Figure 2:
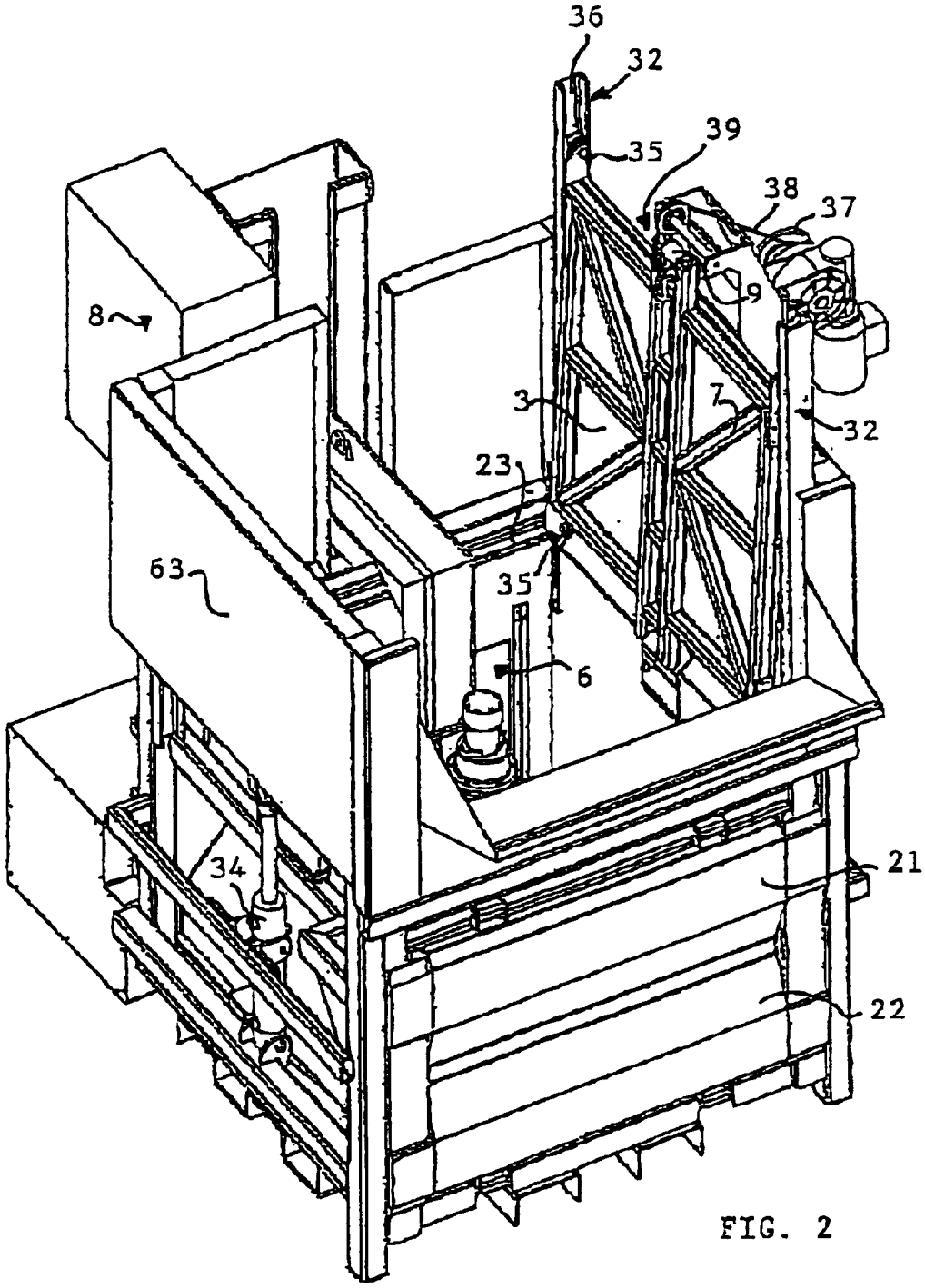
FIG. 2 illustrates the compactor shown in FIG. 1, viewed in perspective, with the crushing head in the active position inside the bowl and the pressing device in the inactive position.

As shown in particular in FIGS. 1, 2 and 3, the pressure plate 3 has a shape similar to that of the cross section of the bowl 2. More specifically, according to the preferred embodiment illustrated in the figures, the plate is of a square shape and the bowl is of square cross section. The dimensions of the pressure plate 3 are set to correspond to the interior dimensions of the bowl so that it can be moved unimpeded vertically therein by the vertical-translation means while at the same time covering practically the entire surface of the matter contained in the bowl 2.

The bowl 2 of the compactor according to the invention has been chosen to have a square cross section in part, as would also be the case of a rectangular cross section, to facilitate the movement of the plate from its active position inside the bowl 2 to its inactive position when it is retracted out of the bowl 2 for the operation, in the bowl 2, of the crushing head 1. Above all, it has the advantage of facilitating the subsequent handling of the bale obtained, and its storage.

The pressure plate 3 comprises reinforcing elements 7 on each of its two faces. Two parallel edges 30 and 39 of the pressure plate 3 each have a handle 9 for grasping the plate. These two handles 9 project from each of the two edges 30 and 39 and allow the plate to be lowered into the bowl 2, as will be detailed later.

As can be seen in particular in FIG. 1, above the bowl 2 there is a protective shroud 63 which acts as a barrier against the matter expelled from the bowl.

When the crushing head 1 is brought into operation in the bowl 2, as shown in FIG. 2, the pressure plate 3 is in an inactive position, retracted into a storage framework 31. The framework 31 comprises two posts 32 in the continuation of two corners of the bowl 2 and, preferably, as shown in particular in FIGS. 1, 2 and 3, the two posts 32 are in the continuation of two corners of one of the two lateral sides of the bowl. In its inactive position, the pressure plate 3 is in a retracted position with respect to the bowl 2, immobilized between the posts 32 of the framework 31.

To retract the pressure plate 3 from the bowl, the compactor according to the invention comprises in particular a winch 37 about which there is wound and unwound a cable 38 the end of which is fixed to part of the edge 39 of the pressure plate 3. Means are provided for controlling the winding or unwinding of the cable 38 about the winch 37. These means, which have not been depicted in the figures, are connected to means of detecting the level of the pressure plate 3 in the bowl 2. The means for detecting the level of the pressure plate 3 comprise electric sensors positioned at predetermined levels in the bowl 2. They can be used to provide an indication of the degree of compacting due specifically to the compacting by the pressure plate. Their main use lies in the automatic control of the change in position of the device and the alternating intervention of the rotary roll ahead.

In order not to impede the descent of the plate 3 into the bowl 2, the shredding roll 11 is kept in an inactive position at a height above the bowl 2 such that it does not impede the descent of the plate 3 into the bowl. In order to clutter up as little as possible the space over the bowl, and as can be seen in FIG. 1, for example, the shredding roll 11 is arranged opposite the plate 3 with respect to the axis of the bowl 2, leaving the pressure plate 3 free passage when placed into the bowl 2.

Among the automatic control means, the compactor in particular comprises an electric sensor positioned in the bowl 2 and which detects that the axis of the roll 11 is in the desired position when the roll 11 moves past it in the gyratory movement of the crushing head 1. When the axis of the roll is in the desired position, the electric sensor sends a signal to the control means 8 to almost instantly stop the gyratory movement of the crushing head 1 about the axis of the bowl 2 and the rotational movement of the roll 11 about itself. Because the roll 11 rests on the matter under its own weight, the resistance exerted by the matter on the roll 11 to slow its rotational movement is such that when the gyratory movement of the crushing head 1 stops, the rotational movement of the roll 11 about its axis is also stopped.

In this way, when the crushing head 1 is raised back up above the bowl 2 to be immobilized in the inactive position, the roll 11 is in a position such that it cannot impede the descent of the pressure plate 3 into the bowl 2.

When the crushing head 1 is in the active position, the pressure plate pressing device 3 is kept in the inactive position. Likewise, as long as the pressure plate 3 is in the active position inside the bowl, the crushing head is kept in the inactive position.

To achieve this, the control means 8 do not trigger the bringing of the crushing head in the active position inside the bowl until the pressure plate pressing device 3 has been retracted into the inactive position outside the bowl. Conversely: the control means 8 do not trigger the bringing of the pressure plate pressing device 3 into the active position inside the bowl until the crushing head 1 has been retracted into an inactive position outside the bowl.

Figure 5:
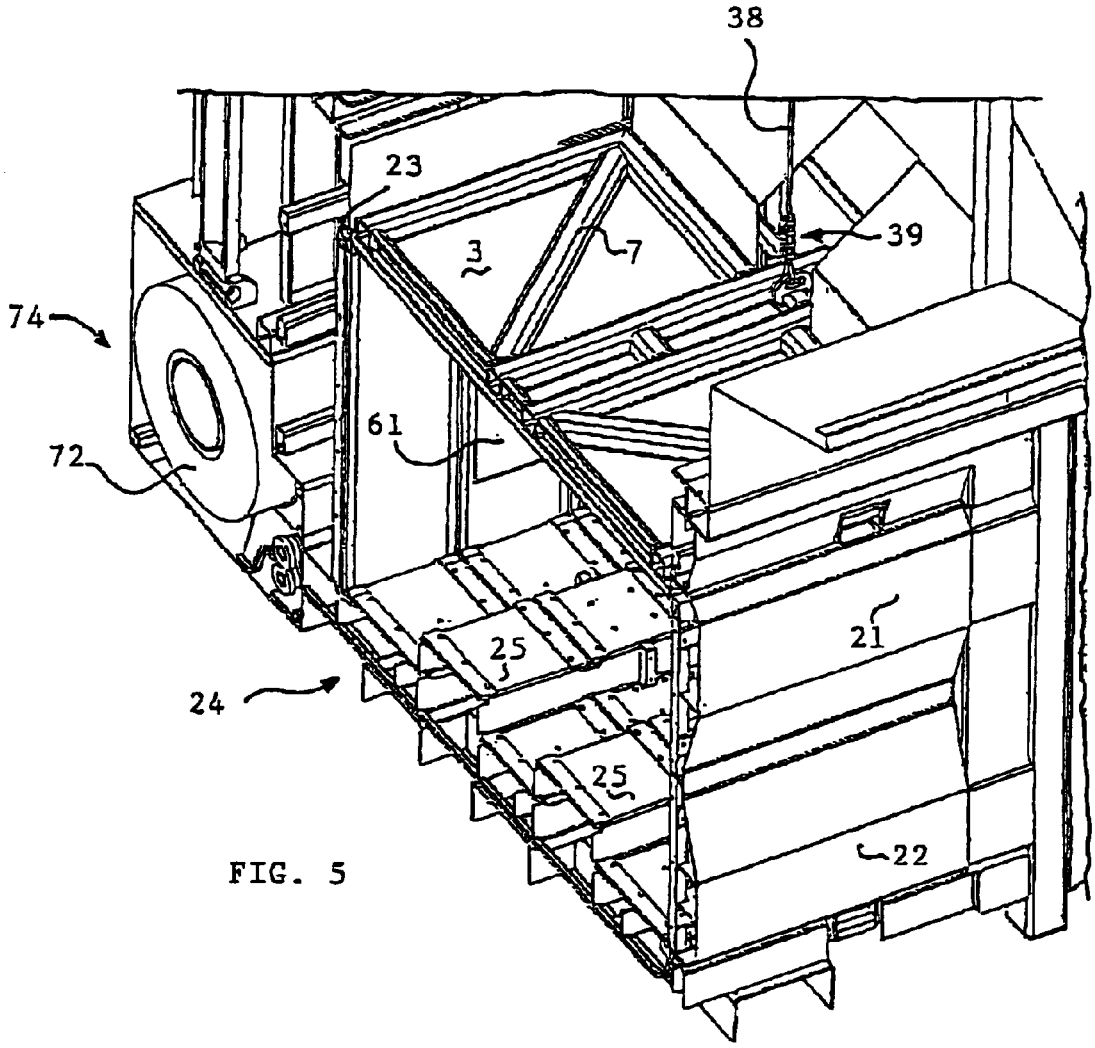
FIG. 5 depicts the device viewed partly in lateral section, so as to show the shaping bottom with its two retractable projections.
Figure 6:
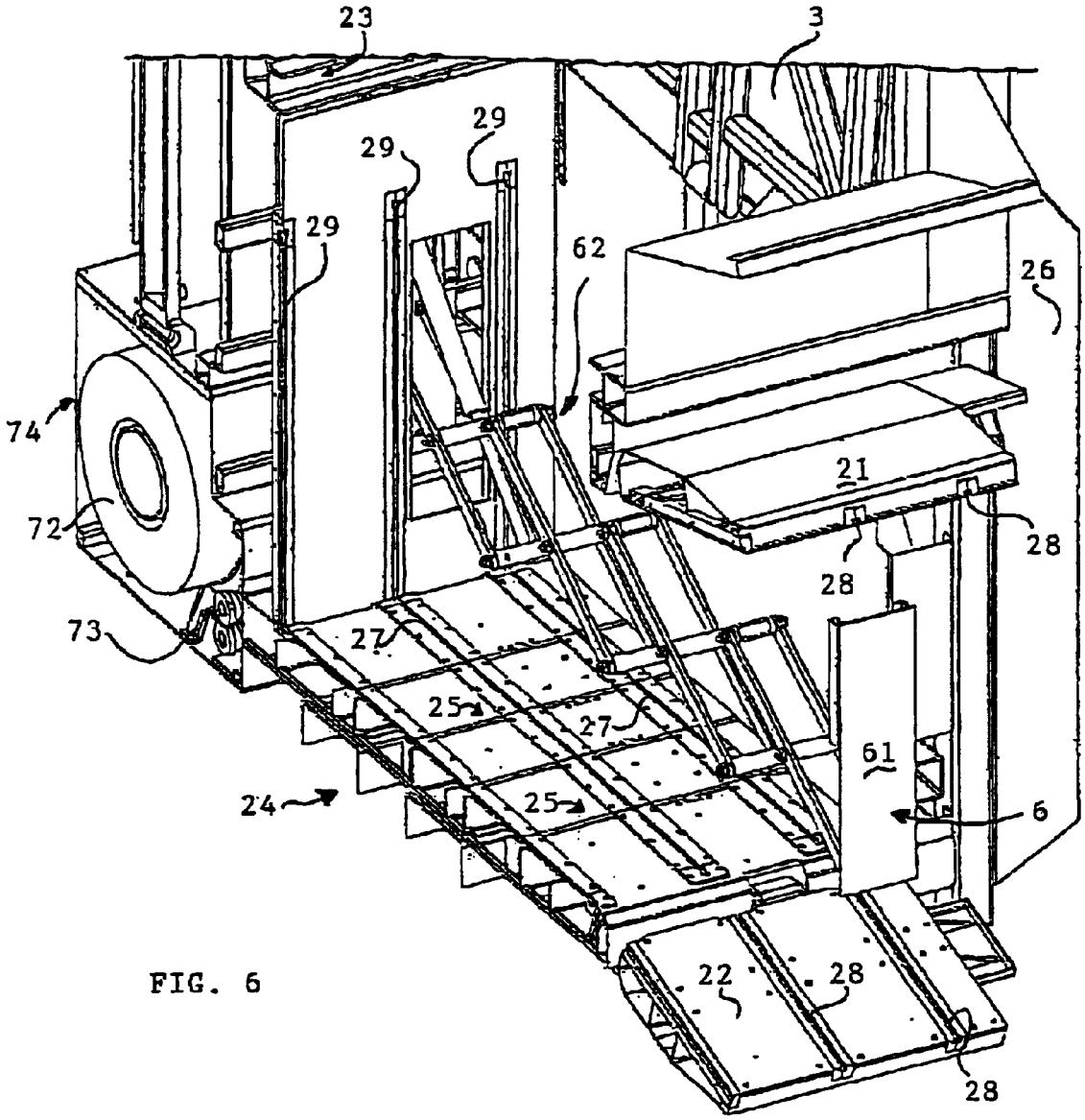
FIG. 6 shows the device viewed partly in lateral section, with the leaves of the door being open and the expulsion means being operated in order to eject a bale of compacted matter.

To allow the pressure plate 3 to be brought into place in the bowl, the plate 3 in particular comprises four parts 35 mounted to project from each of its four corners. Two of the four parts 35 are mounted so that they can move in rails 36 made in each of the posts 32 of the framework 31. The other two parts 35 are mounted so that they can move in rails 23 provided in two parallel corners of the bowl 2, these corners being the ones perpendicular to the posts 32 (FIGS. 2, 5 and 6).

When the pressure plate 3 is set in place in the bowl 2, the parts 35 glide gently in the rails 36 and 23, the pressure plate 3 being restrained by the cable 38 unwinding from the winch 37. The plate is then set in place in the bowl 2, being tilted until it lies parallel with the bottom of the bowl 2. According to this preferred embodiment of the compactor, the pressure plate 3 is tilted and lowered into the bowl under its own weight.

To drive the plate 3 in vertical translation in the bowl when it is parallel to the bottom of the bowl, the compactor according to the invention has two grippers 33. These are each connected to a hydraulic press ram 34, which keeps the pressure plate 3 in position at least via one of these four edges. Advantageously, and as shown in FIG. 4, the two grippers 33 grip the handles 9 of the edges 30 and 39 of the plate 3 (FIG. 4).

To protect the grippers 33 and the rams 34 which are arranged on the outside of the bowl 2, the pressing device according to the invention comprises a protective skirt 26 depicted in particular in FIG. 4.

When the plate 3 is in place in the bowl, the sensors detect the horizontal position of the plate in the bowl. They then send a signal to the control means 8 to position the grippers 33 on the handles 9 of the edges 30 and 39 and to trigger the vertical translational movement of the plate in the bowl (FIG. 4). The grippers 33 pull the plate 3 toward the bottom of the bowl by increasing the pressure in the rams 34.

As it descends down inside the bowl 2, the plate 3 begins by levelling the surface of the matter; as the crushing head 1 effects a circular movement in the bowl 2 and as the bowl 2 is of square cross section, the matter in the four corners of the bowl will not have been fully shredded and distributed through the bowl 2. The pressure plate 3 therefore initially remedies this uneven distribution of the matter that is to be compacted in the bowl 2. It then compresses the matter against the edges of the bowl 2 until it has sunk to a predetermined level.

As is explained before, the bowl 2 is of square cross section. To allow the gyratory movement of the crushing head 1 about the axis of the bowl 2, the side length of the cross section of the bowl 2 is at least equal to twice the length of the shredding roll 11.

The bowl 2 also has a door comprising two leaves 21 and 22 to allow the bales of matter to be removed from the compactor. The two leaves 21 and 22 are mounted articulated about two horizontal axes. More specifically, the hinges of the two leaves are parallel to the bottom of the bowl. The bowl thus has a top leaf 21 and a bottom leaf 22. This preferred mounting of the door on the bowl 2 saves space around the compactor in the workshop.

This is because if the leaves were articulated about vertical axes, as is customary, it would be necessary to leave empty spaces on each side of the compactor so as to open the leaves. By virtue of this particular mounting of the leaves 21 and 22, there is no longer any need to leave empty spaces on each side of the compactor, the leaves in the open position occupying only some of the space lying in front of the opening of the bowl 2 and which has to be left free so that a fork-lift truck can get in.

In order to offer better resistance to the forces exerted by the compacting of the matter against the internal walls of the bowl 2, the door is opened and closed by a hydraulic system. In this way, when the leaves 21 and 22 are closed, a force due to the hydraulic pressure prevents the leaves 21 and 22 from opening under the force exerted by the matter compressed against the walls of the bowl 2. This system thus avoids the uncontrolled opening of the leaves 21 and 22 of the door of the bowl 2 during compacting.

Furthermore, this system makes it possible to keep the leaves 21 and 22 in an open position. Specifically, if this system were not employed, the top leaf 21 would have a tendency to close itself under the force of gravity because the leaves 21 and 22 are mounted articulated on horizontal axes.

Finally, the bottom leaf 22 facilitates the unloading of the bales when it is open. This is because, as shown in particular in FIG. 6, the bottom of the bowl 2 of the compactor is raised up slightly off the floor on which the compactor is placed. In the context of this advantageous embodiment, the bottom leaf 22 acts as a ramp for unloading the bales of matter between the raised level of the bottom of the bowl 2 with respect to the floor and the floor on which the compactor according to the invention is placed. This facilitates the unloading of bales from the bowl 2 when the bales are pushed out of the bowl 2 by the expulsion means 6 which will be described later on.

The bottom 24 of the bowl is so constituted that it is effective for shaping the bales of compressed matter to allow the bales to be moved around directly using a fork-lift truck. The underside of the shaping bottom 24 of the bowl 2 for this purpose has two elongated projections 25 on the shaping bottom 24. The two projections 25 are linear and mutually parallel. They extend throughout the width of the bowl. They have the purpose of forming in the bales finally obtained two grooves for the passage of the two forks of a fork-lift truck. The bales of matter can therefore be moved around more readily because there is no longer any need to place a bale on a pallet. As shown in FIG. 5, the projections 25 are made of parts of the bottom of bowl 2 that can be brought upwards away from it, but are retractable in said bottom, Thus, they can be each folded down to the same level as the bottom 24 of the bowl 2 so as to make it flat. As illustrated by FIG. 5, the direction of the two projections 25 is chosen perpendicular to the direction of extraction of the bales.

The compactor further comprises means for maintaining cohesion of the bale of compacted matter obtained at the end of the compacting operations, once the pressure exerted by the pressing device has been released, by surrounding the bale with tapes before the pressure plate is removed. A housing 74 to accommodate reels 72 of tape is provided at the base of the frame 4, so as to occupy the least possible amount of space. As it appears from FIG. 6, the housing 74 apart from containing the reels 72 of tape also contains means for guiding the tape into grooves 27 formed in the walls of the bowl 2. These means comprise a launch tube 73 which on the one hand guides the end of the tape and on the other hand allows it to be propelled into one of the grooves 27. The launch tube 73 has characteristics such that it ensures that the tape be propelled into the grooves 27 with sufficient force that it make at least one complete turn around the bowl 2.

Furthermore, the compactor according to the invention comprises means for commanding the opening of the door which allow the leaf 21 to be opened independently of the opening of the leaf 22. Keeping the bottom leaf 22 closed allows the matter to be kept under pressure by exerting lateral pressure on the matter. As the top leaf 21 of the door of the bowl 2 can be opened by itself, an operator can then join two ends of tape together using a crimping machine. This crimping machine secures two ends of the tape by pulling on each of the strands to keep the matter surrounded by the tape under pressure, heating the two strands by friction and cutting the tape, so as to enable releasing the bale from the bowl.

To guide the tapes around the bale of matter, the bowl 2 has tape-guiding grooves 27 which are formed in the walls of four of these sides. Thus, the bottom 24 of the bowl has five grooves open toward the side of the bowl (FIG. 4). The side of the bowl that has the doors 21 and 22 and the opposite side thereto also and respectively comprise five grooves 28 and 29 (FIG. 6) open toward the inside of the bowl. The five grooves 27, 28 and 29 of each of the sides of the bowl are made in such a way that the five grooves of one of the sides of the bowl 2 are in the continuation of five other grooves of an adjacent side. The upper part of each of the projections 25 of the bottom 24 of the bowl also comprises tape-guiding grooves which register with the guide grooves 27 in the shaping bottom 24 when the projections 25 are retracted thereinto, in other words, when the upper parts of the projections 25 are in the same plane as the surface of the shaping bottom 24.

For the tape to be able to make a complete turn around the bale when the pressure plate is still keeping it under pressure, the pressure plate 3 also has tape guide grooves 20 open toward the inside of the bowl and which register with the grooves 28 and 29 (FIG. 6). The grooves 20 formed in the underside of the plate are therefore also five in number. Because the grooves 27, 28 and 29 of the bowl and the grooves 20 of the plate 3 are formed in the continuation of one another, the tapes make a complete turn around the bale of compacted matter when so projected by the launch tubes 73.

As explained earlier, the projections 25 that the shaping bottom 24 of the bowl 2 has are perpendicular to the direction in which the bale of compacted matter leaves. Thus, as can be seen particularly in FIG. 6, the tape guide grooves 27 cross the projections 25 at right angles. This allows the bound bale of matter not to break up when picked up by the fork of a pallet truck. Indeed, if the binding were in the same direction as the projections 25, when the bale was seized by the forks of the truck, it would break in two, on each side of each of the forks of the truck. In the context of this preferred embodiment, as the binding is done at right angles to the direction of the projections 25, this problem does not arise.

The expulsion means 6 (FIG. 6) for expelling the bale of matter that the compactor according to the invention has are semi-automatically controlled. What happens is that, for workshop safety reasons, the means for ejecting a bale, the weight of which may be close on 200 kilograms, cannot be operated without the approval of the operator who beforehand will have checked that no-one from the workforce is standing in front of the compactor. Having performed this check, the operator triggers the bale expulsion means 6. The triggering of the expulsion means by the operator may be performed, for example, by pressing a control button connected to the control means 8. The control button has not been depicted in the drawings, in order to make the figures clearer.

The triggering of the bale expulsion means 6 leads first of all to the opening of the bottom leaf 22 of the door of the bowl 2. Then, two push plates 61 are ejected from a wall of the bowl and push the bale out of the bowl 2. According to the preferred embodiment of the invention herein described, the push plates 61 are mounted on the compactor in the lateral wall opposite to the door leaves 21 and 22. As shown in FIG. 6, they are actuated by an expandable structure 62 made of articulated rods. During operation of the compacting means they are retracted into the wall of the bowl so that the latter be flat and can resist to the pressure of the matter when submitted to the compression device. The plates 61 are vertically elongated so as not to alter the compacted matter upon ejection or the bale.

The compactor according to the invention restarts semi-automatically. The operator needs to check that the bale has indeed been expelled from the bowl of the compactor before actuating the means for resuming the operation of the compactor. The means for resuming operation of the compactor are actuated by pressing a button situated at the control means 8. That makes it possible to avoid any possible damage to the hardware, particularly to the leaves 21 and 22 of the door, should it turn out that a bale has not been fully ejected, for example if the bale has remained partly on the bottom leaf 22 of the door of the bowl.

The means for resuming operation of the compactor according to the invention control closure of the two leaves 21 and 22 of the door of the bowl 2, the raising of the plate 3 in the storage chassis 31 by winding of the cable 38 about the winch 37, the lowering of the crushing head 1 into the bowl 2 and its return to activity, in other words the triggering of the gyratory movement of the crushing head 1 about the axis of the bowl and the rotational movement of the roll 11 about itself.

The main elements that the compactor according to a preferred embodiment of the invention has have just been explained. The preferred mode of operation of the compactor according to this embodiment will now be described.

When the compactor is not operating, the crushing head 1 is in the raised position and the pressure plate 3 is stored and immobilized in the framework 31. The operator presses a button which switches the compactor on. The crushing head 1 is then unlocked from its raised position and it descends into the bottom of the bowl 2 to reach its lowered position as shown in FIG. 2. The level of the lowered position of the crushing head 1 is a few centimeters from the uppermost level of the projections 25 in the bottom of the bowl 2, so that no element of the crushing head 1 damages the bottom 24 of the bowl 2. When it has reached the lowered position, the drive means 14, 12, 51 for driving the rotation of the roll 11 on itself and for driving the gyratory movement of the crushing head 1 about the axis of the bowl 2 are switched on. The matter for compacting is introduced directly into the bowl 2 from the top. The matter introduced is then shredded and levelled by the crushing head 1, as the roll passes over them during its movement in the bowl.

When the level of the matter reaches the maximum predetermined level in the bowl, a "bowl full" signal is emitted. A position sensor transmits a signal to the control means 8 which instantly shut down the rotational movement of the roll on itself and the gyratory movement of the crushing head about the axis of the bowl. The control means then trigger the raising of the crushing head 1 to its inactive position. When the crushing head 1 reaches the level of its raised position, the control means trigger the bringing of the compression plate pressing device 3 into its active position.

The passage of the pressure plate pressing device from its inactive position to its active position results first of all in the lowering of the pressure plate 3 under its own weight into the bowl as the cable 38 is unwound from the winch 37. To achieve this, the parts 35 of the plate 3 glide in the rails 36 of the two ports 32 of the framework 31 and in the rails 23 of the bowl 2. When the plate position sensors detect that the plate is in the horizontal position in the bowl, the fitting of the grippers 33 onto the handles 9 of the edges 30 and 39 of the plate is commanded. Then, by increasing the pressure in the hydraulic rams 34, the plate is moved toward the bottom of the bowl, pulled by the two grippers 33 connected to the rams 34 until the pressure in the rams reaches a predetermined pressure threshold. As it descends down inside the bowl 2, the plate 3 compresses the matter against the shaping bottom 24 and the internal side walls of the bowl, levels the surface of the matter in the bowl and homogenizes the density with which the matter is compacted in the bowl. By virtue of the pressure exerted by the pressure plate 3 on the matter, the matter forms a bale adopting the interior shape of the bowl.

When the predetermined pressure threshold is reached in the rams, the descent of the plate is halted and the pressure plate is held in position. The projections 25 in the shaping bottom 24 are then retracted so that the shaping bottom of the bowl is flat. The five grooves 27 formed in the bottom of the shaping bottom, the five grooves formed in the upper part of each of the projections 25 (the upper part here lying in the same plane as the upper part of the bottom 24 of the bowl) and those formed in the projections 25 are then in register with each other. The control means then trigger the launch of five tapes through the launch tubes 73 into the grooves 27 of the bowl 2 and of the pressure plate 3. The tapes then make a complete turn around the bale of compacted matter. The operator then commands the opening of the top leaf 21 of the bowl 2 to join two strands of each of the five tapes together. To do this, the operator uses a tape crimping device which pulls on each of the two strands of a tape, connects them by heating them by friction and cuts off the end of the tape connecting the bale to the bowl.

When each tape has been crimped and cut, the pressure plate 3 is then raised up far enough in the bowl for the control means to trigger the halting of the raising of the plate. Once the pressure plate has stopped, the operator can trigger the bale expulsion means. The bottom leaf 22 of the door of the bowl opens. When the control means detect that the bottom door is completely open, they trigger the operation of the push rods 6 which are then pushed toward the door of the bowl and push the bale out of the bowl.

If the bale is correctly expelled from the bowl, the operator commands the closure of the leaves 21 and 22 of the compactor. The plate is then raised again and the grippers 33 let go of the handles 9 of the edges 30 and 39 of the pressure plate 3. The projections 25 are once again pivoted into a raised position in the bottom 24 of the bowl 2. The pressure plate 3 is then raised back up inside the framework 31, between the two posts 32 of the framework 31. For that, the control means trigger the winding of the cable 38 about the winch 37, pulling on the edge 39 of the pressure plate. This action causes the parts 35 of the plate 3 to glide in the rails 23 and 36. When the plate is positioned vertically between the posts 32, the pressure plate 3 remains locked in this position of inactivity. Once the pressure plate 3 is retracted out of the bowl in the inactive position, the crushing head is lowered into the bowl. Then the means for driving the rotation of the roll on itself and the gyration of the crushing head about the axis of the bowl are implemented.

As far as the bale expelled from the compactor is concerned, it is moved around, for example to a bale storage depot, using the fork-lift truck. To do this, the two forks of the truck are inserted in the grooves formed in the bales of compacted matter by virtue of the shaping bottom of the bowl, between the closed ends of the grooves and the tapes that keep the bale under pressure.

The foregoing description clearly explains how the invention makes it possible to achieve the objectives it set itself.

In particular, it is apparent from the description that the compactor according to the invention allows more homogeneous compacting of matter by virtue of the respective actions of the crushing head and of the pressure plate employed one after the other in the bowl. It is nonetheless evident from the foregoing that the invention is not restricted to the embodiment specifically described and depicted in the figures.

The entire disclosure of all applications, patents and publications, cited herein and of corresponding French application No.FR 0211785, filed 24 Sep. 2002 are incorporated by reference herein.

From the foregoing description, one skilled in the art can easily ascertain the essential characteristics of this invention and, without departing from the spirit and scope thereof, can make various changes and modifications of the invention to adapt it to various usages and conditions.

What I claim is:

1. A waste compacting device or compactor, comprising a bowl for receiving matter to be compacted, a crushing head comprising at least one shredding rotative roll travelling upon the surface of the matter when said crushing head is in an active position inside said bowl, a pressing device with a pressure plate associated with translation means to compress said matter onto a bottom of said bowl when pressing device is in an active position inside said bowl, and configuration means to move said crushing head and said pressing device, each in turn, into its active position inside the bowl while the other is in an inactive position outside the bowl.

2. A compactor according to claim 1 wherein said crushing head is rotated about a vertical axis of said bowl along which said crushing head is mounted movable in vertical translation when said crushing head is in operation in said bowl while said matter to be compacted is introduced through an open top of the bowl.

3. A compactor according to claim 2 wherein said bowl is of rectangular cross-section and said pressure plate is so dimensioned that said pressure plate extends over all said cross-section when said pressure plate is brought in its active position to operate to press the crushed matter in the bowl.

4. A compactor according to claim 2 wherein said bowl shows a square cross-section.

5. A compactor according to claim 1 wherein said configuration means comprise first configuring means to cause the crushing head with rotary roll to move from an inactive position outside the bowl to its active position inside the bowl when the pressure plate-pressing device is set into an inactive position outside the bowl, and second configuring means to cause said pressing device to move in its active position inside said bowl after the crushing head has been moved from its active position to its inactive position.

6. A compactor comprising:—a bowl for receiving matter to be compacted that is introduced through an open end thereof;—a crushing head comprising at least one shredding rotative roll travelling upon the surface of the matter when said crushing head is in an active position inside said bowl, said crushing head being associated with means to rotate said crushing head about a vertical axis of said bowl along which said crushing head is mounted movable in vertical translation;—a pressing device comprising a pressure plate associated with means to translate said pressing device along said vertical axis when said pressing device is in an active position inside said bowl so as to compress said matter onto a bottom of said bowl, said pressure plate being so dimensioned that said pressure plate then covers all the matter in the bowl;—and configuration means to move said crushing head and said pressing device, each in turn, into its active position inside the bowl while the other is in an inactive position outside the bowl.

7. A compactor according to claim 6 wherein said configuration means comprise first configuring means for said crushing head that are actuated to move said crushing head from its active position inside the bowl wherein said roll rests upon the surface of the matter being compacted to its inactive position by moving said crushing head upwards along said vertical axis until it is outside the bowl above the matter.

8. A compactor according to claim 6 wherein said configuration means comprise second configuring means for said pressing device that are actuated to move said pressing device between its active position and its inactive position by pivoting said pressing device around an horizontal axis at the upper end of a lateral wall of said bowl, said inactive position of the pressing device being thereby laterally aside the bowl.

9. A compactor according to claim 6 wherein said configuration means comprise first configuring means for said crushing head that are actuated to move said crushing head from its active position inside the bowl wherein said roll rests upon the surface of the matter being compacted to its inactive position by moving said crushing head upwards along said vertical axis until it is outside the bowl above the matter, and second configuring means for said pressing device that are actuated to move said pressing device between its active position and its inactive position by pivoting said pressing device around an horizontal axis at the upper end of a lateral wall of said bowl, said inactive position of the pressing device being thereby laterally aside the bowl.

10. A compactor according to claim 9 wherein said bowl is of rectangular or square cross-section and said pressure plate is so dimensioned that it extends over all said cross-section when it is brought in its active position to operate to press the crushed matter in the bowl.

11. A compactor according to claim 6 comprising control means for actuating first said crushing head in said bowl upon newly introduced matter, then removing said crushing head in its inactive position to let the pressure plate of said pressing device pass into the bowl, then actuating said pressing device to press the crushed matter onto the bottom of the bowl.

12. A compactor according to claim 11 further comprising means to eject a final bale of compacted matter from the bowl by pushing said final bale through an open door provided in a lateral wall of said bowl.

13. A compactor according to claim 6 further comprising means to surround a final bale of compacted matter with tapes that are guided in grooves provided therefore in the walls of the bowl and in the pressure plate and means to launch said tapes after the pressure exerted by the pressing device has been released and the pressure plate has not been removed yet.

14. A compactor according to claim 6 wherein said bottom of said bowl is conformed as a shaping bottom for a final bale of compacted matter comprising two projections extending across said bottom that can be retracted at the same level as the fixed parts thereof.

* * * * *

UNITED STATES PATENT AND TRADEMARK OFFICE

CERTIFICATE OF CORRECTION

PATENT NO. : 6,851,354 B2
DATED : February 8, 2005
INVENTOR(S) : Eric Morisse

It is certified that error appears in the above-identified patent and that said Letters Patent is hereby corrected as shown below:

Title page,
Item [75], Inventor, "Toussiant" should read -- Toussaint --

Column 15,
Line 25, reads "when pressing" should read -- when said pressing --

Signed and Sealed this

Seventeenth Day of May, 2005

JON W. DUDAS
*Director of the United States Patent and Trademark Office*